343-700 MS AU 256 EX
4/8/80 OR 4,197,545

United States Patent [19]

Favaloro et al.

[11] 4,197,545

[45] Apr. 8, 1980

[54] STRIPLINE SLOT ANTENNA

[75] Inventors: Cosimo J. Favaloro, Concord, Mass.; Maurice A. Bergeron, Nashua, N.H.

[73] Assignee: Sanders Associates, Inc., South Nashua, N.H.

[21] Appl. No.: 869,543

[22] Filed: Jan. 16, 1978

[51] Int. Cl.[2] ..... H01Q 1/38; H01Q 13/18
[52] U.S. Cl. ..... 343/700 MS; 343/767
[58] Field of Search ..... 343/705, 708, 767, 768, 343/789, 700 MS, 829

[56] References Cited

U.S. PATENT DOCUMENTS

| | | | |
|---|---|---|---|
| 2,636,987 | 4/1953 | Dorne | 343/789 |
| 3,653,052 | 3/1972 | Campbell | 343/708 |
| 3,665,480 | 3/1972 | Fassett | 343/700 MS |
| 4,017,864 | 4/1977 | Proctor | 343/767 |
| 4,063,246 | 12/1977 | Greiser | 343/700 MS |

*Primary Examiner*—Eli Lieberman
*Attorney, Agent, or Firm*—Louis Etlinger; Joseph E. Funk

[57] ABSTRACT

A slot antenna capable of relatively broad bandwidth operation is disclosed that may be used for wide angle scanning in phased arrays. By shorting the feed element to the slot radiator at multiple points, the relatively broad bandwidth operation is achieved.

3 Claims, 5 Drawing Figures

STRIPLINE SLOT ANTENNA

BACKGROUND OF THE INVENTION

This invention relates to antennas and more particularly, to slot antennas adapted for use on aircraft and other high speed vehicles.

Due to the high speed of modern aircraft and missiles, it is important that the size of protuberances from the surfaces of the craft be kept small, or possibly eliminated. As all such craft have electronic equipment which require antennas, considerable work has been done toward reduction of the size of such antennas and mounting such antennas flush with the surface of the craft. Antennas employing a slot radiator are particularly useful for flush mounting as the slot is located flush with the skin of the craft and is backed by a cavity within the craft. These slot antennas comprise a slot from which electromagnetic energy is radiated, a cavity, and a probe for applying energy to the antenna in the cavity. The slot opening itself is usually not an actual opening that will create drag but rather is a sheet of dielectric material flush with the hull. The dimensions of a radiating slot antenna are generally determined by the frequency of the energy to be radiated therefrom. For very high frequencies, the dimensions of a slot become small and, in order to obtain good directivity and gain, it is often necessary to employ an array of these slot antennas. The use of an array of slot aerials also lends itself to beam steering by controlling the phasing of the energy applied to the probe behind each slot.

Small changes in the frequency of energy input to slot antenna with resident cavities produce changes in the impedance of the antenna which restricts the frequency operation of the slot antenna to the design frequency plus or minus approximately a three percent change in frequency. Such a relatively narrow frequency band of operation greatly limits the use of present slot antennas.

SUMMARY OF THE INVENTION

A slot antenna is provided wherein the slot is fed by a conventional strip transmission line having a "T" shaped probe with the top thereof underlying and centered in the slot opening and both ends of the top of the "T" probe extend beyond the slot and are grounded. The grounded "T" section of the probe provides capacitive reactance to cancel out inductive reactance created by the walls of the cavity behind the slot and thereby effecting increased frequency bandwidth of operation of both individual slot antennas and arrays of such slot antennas.

DESCRIPTION OF THE DRAWINGS

The invention will become apparent to those skilled in the art when referring to the specific embodiments of the invention described in the following specification and shown in the accompanying drawing in which.

DETAILED DESCRIPTION

Figure 1:
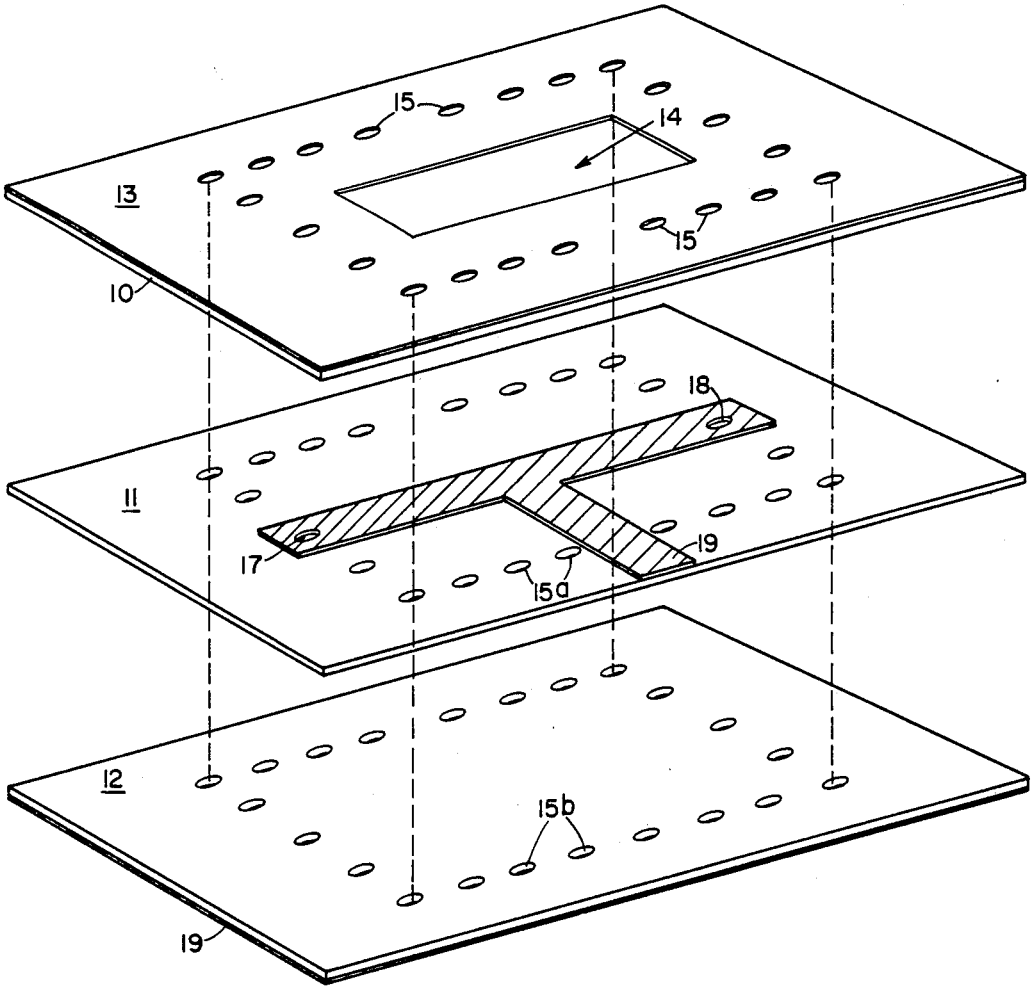
FIG. 1 is an exploded perspective view of my novel slot antenna, having a single slot.

Referring now to FIG. 1, therein is shown an exploded perspective view of a one slot antenna in accordance with the teaching of my invention. As may be seen in FIG. 1, this antenna is made up of three printed circuit boards, 10, 11 and 12, each having a thin, copper layer bonded thereto which is etched according to a given design in a manner well known in the art. Board 10 has bonded its top surface with a thin sheet of copper 13 and rectangular area 14 is created by etching the copper away from this area. In addition, Board 11 has a plurality of holes 15 therethrough surrounding rectangular area 14 which is the radiating slot of my novel antenna.

Printed circuit board 11 is manufactured using printed circuit board techniques to etch away all the copper on the top of board 11, except for the "T" shaped probe 16. It should be noted that there are a plurality of holes **15*a* through board 11 as shown and holes 17 and 18 pass through the ends of the top portion of the "T" probe as shown. Upon assembly of the slot antenna, probe 16 is centered with slot 14 as shown in FIG. 2**.

Printed circuit board 12 has a thin layer of copper 19 bonded to its bottom surface, none of which is etched away. There are a plurality of holes **15*b* drilled through board 12 as shown. It should be noted that holes 15 through board 10, holes 15*a* through board 11, and holes 15*b* through board 12, are all in axial registration with each other as shown by dashed lines in FIG. 1. On assembly boards 10, 11 and 12 are sandwiched together and are fastened together in one of two manners. Individual rivets may be placed through each of holes 15 and the corresponding holes 15*a* and 15*b* which are in registration therewith to fasten the board together. In the alternative, wave soldering techniques may be used to plate through each of holes 15 and its corresponding holes 15*a* and 15*b* . Whether rivets or plate through techniques are used the purpose is to electrically connect copper surface 13 of board 10 to copper surface 19 of board 12. In the process, the two opposing ends of the top of the "T" probe 16 are also connected to copper surfaces 13 and 19 due to the rivets or plate through passing through holes 17 and 18. When boards 10, 11 and 12 are sandwiched together and are fastened, using rivets or plate through techniques, the slot antenna will appear as is shown in FIGS. 2 and 3**.

In operation, radio frequency energy is input via path 19 to the top arms of the "T" probe 16, which arms are terminated via holes 17 and 18 as previously described. In actual operation the ends of the "T" probe arms at holes 17 and 18 will be at ground potential due to the rivets or plated through holes as surface 13 of board 10 and surface 19 of board 12 are electrically interconnected and grounded. When a slotted plate, such as plate 10 is excited by the radio frequency energy applied to path 19 of plate 11, the slot acts analagous to a dipole antenna and radiation will be emitted from both sides of copper plate 13 on board 10. To limit the radiation to only one side of plate 10, and more specifically to the top side on which is located plate 13, a resonant cavity is provided made up of copper sheeting 19 on the bottom of board 12 and the rivets or solder plated through holes 15, **15*a* and 15*b*. The depth of the cavity, that is from the top of board 10** to the bottom of board 12 when the three boards 10, 11 and 12 are assembled as is shown in FIG. 3, should normally be a quarter wavelength or an odd multiple thereof as calculated for a waveguide of the same cross sectional dimensions. The distance between the side edges of slot 14 made up of rivets 20 should normally be a half wavelength or multiple thereof as measured in air. However, as boards 10, 11 and 12 are made of a dielectric material which fills the cavity defined above, the wavelength of the electromagnetic energy therein will be less than the free air wavelength of the electomagnetic energy as is well known in the art. As a result, the cavity dimensions are made smaller.

Figure 2:
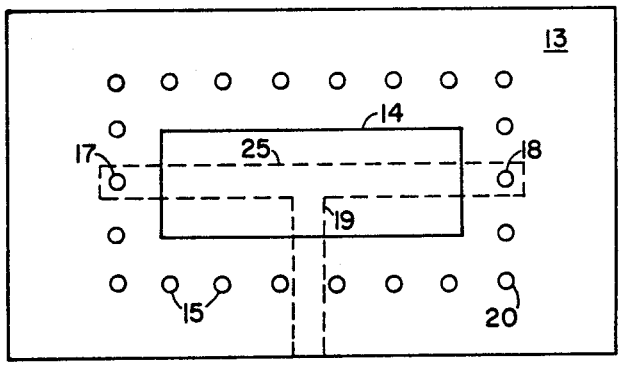
FIGS. 2 and 3 are top and edge views, respectively, of an assembled one slot antenna in accordance with the teaching of my invention.
Figure 3:
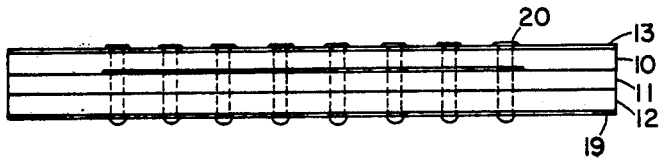

In FIG. 2, is shown a top view of the assembled antenna, while FIG. 3 shows a side view thereof. For ease of discussion only, the antenna is assembled using rivets 20, but may be assembled using plated through holes using wave soldering techniques. This type of antenna has basically two parts, the resonant cavity made up of the rivets 20, copper sheeting 19 on board 12, and the slot opening 14 through copper sheet 13 on board 10. The slot opening 14 responds to a high frequency signal applied to copper conductor 19 on board 11 to excite currents in the conducting sheet 13 around slot 14. The cavity just described is electrically in parallel with slot opening 14 and acts as a parallel resonant circuit connected across the slot. The impedance of the shunting resonant cavity varies with its dimensions, therefore, as the cavity becomes smaller, even though its Q remains the same, the loss conductance paralleling the slot increases and the efficiency of the radiation is reduced. The useable bandwidth of any such slot antenna with a cavity there behind increases as the dimensions of the cavity increases. The spacing of the rivets defining the cavity is important. When the rivets are spaced too far apart, there is leakage of energy from the inside of the cavity parallel to the boards 10, 11 and 12. The amount of power that may be handled by this type of slot antenna is limited by the dielectic breakdown of the material making up boards 10, 11 and 12, such material being physically found within the cavity.

More particularly, the top 25 of the "T" probe in the slot window 14 provides sufficient capacitive reactance in parallel with the inductive reactance of the cavity back wall 19, and also provides a series capacitance compensating for the inductance of path 19 leading into the cavity to counteract these inductive effects and thereby provide operation between 7.5 GHz and 8.5 GHz with a VSWR of about 2.0:1.

Figure 5:
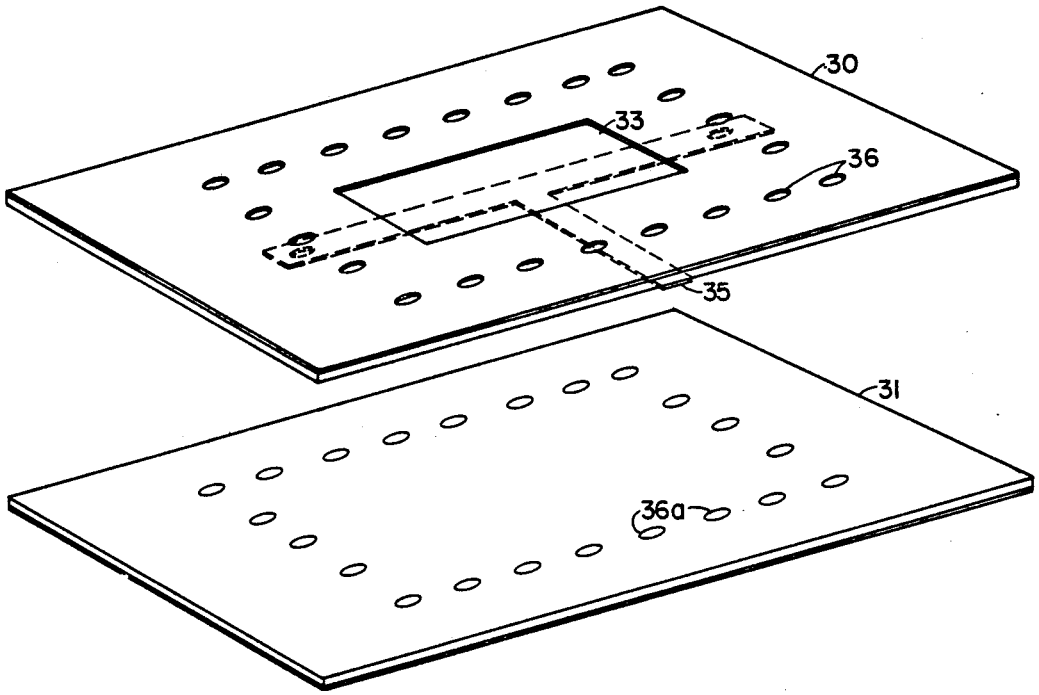
FIG. 5 is an exploded perspective view of an alternative embodiment of my invention.

An alternative embodiment of my invention is shown in FIG. 5 wherein is shown a slot antenna comprising only two printed circuit boards sandwiched together. The uppermost board 30 has a top surface similar to that of board 10 shown in FIG. 1. The difference from the slot antenna shown in FIG. 1 is that the strip transmission line and probe 35 are formed on the bottom side of board 30 utilizing printed circuit techniques rather than on separate board. Since slot 33 and transmission line and probe 35 are manufactured on either side of board 30 in a manner well known in the art, the precise position of slot 33 with respect to probe 35 is easily established and reproduceable in manufacture. Board 31 is identical to board 19 in FIG. 1 in that the copper plating is on the bottom side of board 31. In a manner similar to that shown in FIG. 1, holes such as holes 36 and 36*a* located through both boards 30 and 31 and again, riveting or flowthrough wave solder techniques are utilized to interconnect copper sheeting 32, probe 35 and copper sheeting 34. The most significant difference between the antenna shown in FIG. 5 and that shown in FIG. 1 is that the vertical depth of the cavity behind slot 33 in board 30 is equal to only twice the thickness of the printed circuit board, whereas the vertical depth of the cavity formed in the arrangement of FIG. 1 is equal to three times the thickness of the printed circuit boards. Of course, it is recognized that the thickness of the boards may be selected as desired.

In one embodiment of my invention utilizing only two printed circuit boards as shown in FIG. 5, the specifications for an antenna for X-band operation between 7.5 GHz and 8.5 GHz are as follows. The boards are each made of 0.062 inch teflon fiberglass with copper plating thereon for printed circuit etching. The radiating slot has a length of 0.72 inches and a width of 0.20 inches. The width of the printed circuit paths making up the printed circuit "T" probe are each 0.042 inches wide. The length of the rectangle made up of rivets to define the cavity is 0.80 inches while the width of the rectangle is 0.610 inches. The spacing between each of the rivets or plated through holes making up the rectangle is 0.200 inches. It should also be recognized that flexible printed circuitry may be used instead of rigid boards.

Figure 4:
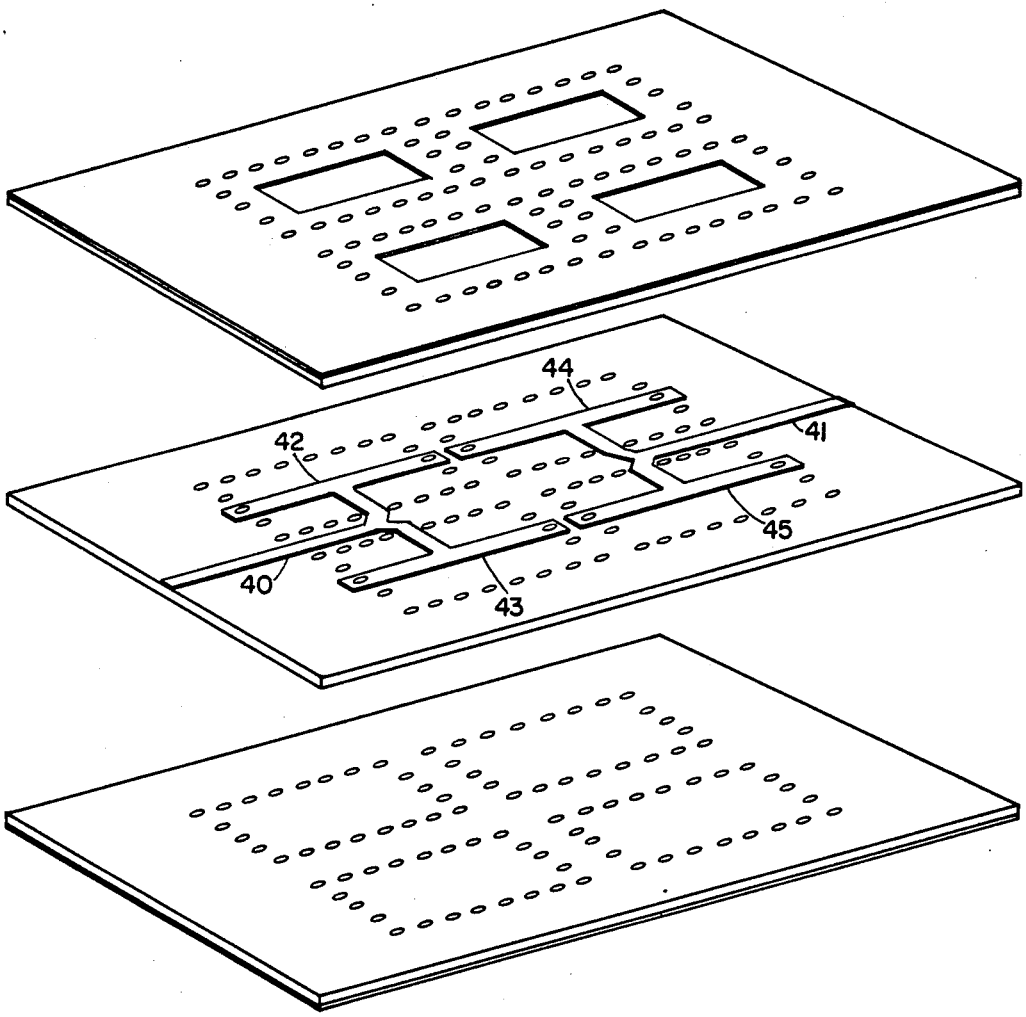
FIG. 4 is an exploded perspective view of a simple 2×2 slot matrix slot antenna incorporating my invention.

In FIG. 4 is shown another embodiment of an antenna utilizing my novel slot antenna. In the simplified form shown in FIG. 4, only four individual slot antennas are located as shown for simplicity of representation.

However, it is to be recognized that a large array of columns and rows of slot antennas may be designed using the basic slot antennas shown in FIGS. 1 and 5. As is well known in the art, such arrays of slot antennas provide higher gain by providing a narrower radiation lobe than a single antenna. In addition, individual slot antennas or groups of slot antennas in an array may be energized with high frequency signals that are not in phase with each other to accomplish beam steering. For example, out of phase signals may be applied to paths 40 and 41 to accomplish beam steering in one plane.

Many mechanical modifications may be made in the specific antennas shown without departing from the scope of the invention as defined in the following claims.

What is claimed is:

1. A slot-type antenna comprising a first printed circuit board having an electrically conductive layer bonded to both sides thereof with the conductive layer on one side of said first board being etched to remove part of said conductive layer thereon to create a window slot, the conductive layer on the other side of said board being etched to remove a portion of said conductive layer thereon to create a conductive probe area that has a "T" shaped with the top thereof being parallel to and underlying said slot so as to be centered in same with the ends of the top of said "T" shaped probe extending beyond said slot, said probe providing capacitive reactance in parallel with inductive reactance of said cavity means sufficient to counteract said inductive reactance to provide broad band operation, a plurality of holes through said first board around and spaced from said slot with two of said holes passing respectively through said ends of the top of said probe as they extend beyond said slot, a second printed circuit board having an electically conductive layer on only one side thereof, said second board also having a like plurality of holes therethrough with each of said plurality of holes through said second board being in axial registration with each of said plurality of holes through said first board when both said boards are sandwiched together with the conductive layer of said second board being on the outer side of said sandwiched pair of boards, and electrical interconnecting means passing through each of said axially aligned holes through both said first and said second boards when said boards are sandwiched together to electrically connect the conductive layer on said one side of said first board to said ends of the top of said "T" probe and to said conductive layer on said second board, said holes with said connecting means therethrough being spaced close enough to minimize electromagnetic radiation caused by energy applied to said probe from radiating other than through said slot, radio frequency energy applied to said probe causing electrical currents in said conductive layer of said one side of said board around said window slot said interconnecting means and said conductive layer on said second board defining a cavity that only permits electromagnetic radiation to emanate from said slot in the direction opposite from said defined cavity.

2. The slot-type antenna in accordnace with claim 1 wherein capacitive reactance due to said probe counteracts inductive reactance due to said cavity at a specific frequency in a band of frequencies at which said slot-type antenna is designed to operate to thereby provide relatively broad band operation.

3. The slot-type antenna in accordance with claim 1 wherein said antenna comprises a plurality of slots as described in claim 1 and arranged in a predetermined pattern, and said probe associated with each of said plurality of slots energized depending on the desired direction of electromagnetic radiation with relation to said plurality of slots.

* * * * *